US005542256A

United States Patent [19]

Batey et al.

[11] Patent Number: 5,542,256

[45] Date of Patent: Aug. 6, 1996

[54] SAMPLE HOLDING DEVICE

[75] Inventors: Graham J. Batey; Eric P. Whitehurst, both of Oxford, United Kingdom

[73] Assignee: Oxford Instruments (UK) Limited, Witney, United Kingdom

[21] Appl. No.: 410,289

[22] Filed: Mar. 24, 1995

[30] Foreign Application Priority Data

Mar. 30, 1994 [GB] United Kingdom ..... 9406348

[51] Int. Cl.[6] ..... F25B 19/00

[52] U.S. Cl. ..... 62/610; 62/51.1

[58] Field of Search ..... 62/51.1, 51.2, 62/51.3

[56] References Cited

U.S. PATENT DOCUMENTS

| | | | |
|---|---|---|---|
| 4,484,458 | 11/1984 | Longsworth | 62/51.2 |
| 4,631,928 | 12/1986 | Walker | 62/51.2 |
| 5,003,783 | 4/1991 | Reale | 62/51.2 |
| 5,189,880 | 3/1993 | Frossati et al. | 62/51.3 |

FOREIGN PATENT DOCUMENTS 2744346 4/1979 Germany .

OTHER PUBLICATIONS

*A Combined* $^3$*He—*$^4$*He Dilution Refrigerator,* V. N. Pavlov, B. S. Neganov, J. Konicek and J. Ota, Cryogenics, Feb. 1978, all pages.

*Simple Dilution Refrigerator,* The Review of Scientific Instruments, vol. 43, No. 2, James L. Levine, Feb. 1972, all pages.

Novel Top–Loading 20 mK/15 T Cryomagnetic System, P. H. P. Reinders, M. Springford, P. Holton, N. Kerley and N. Killoran, Cryogenics 1987, vol. 27, Oxford, UK, all pages.

*Primary Examiner*—Ronald C. Capossela

[57] ABSTRACT

A sample holding device (30) for a dilution refrigerator having a still (16), a mixing chamber (22), and a heat exchanger (26) connected between the still and mixing chamber whereby coolant flows from the still to the mixing chamber and from the mixing chamber to the still through respective first and second adjacent paths in the heat exchanger and wherein the mixing chamber has a tubular portion (27), the sample holding device comprising a tube for insertion in the tubular portion of the mixing chamber and having means (34) for holding a sample within the tubular portion, the tube having an aperture (36) adjacent the sample holding means communicating in use between the interior of the tube and the interior of the tubular portion and another aperture (37) positioned in use to communicate between the interior of the tube and the second path in the heat exchanger.

13 Claims, 3 Drawing Sheets

SAMPLE HOLDING DEVICE

FIELD OF THE INVENTION

The invention relates to a sample holding device for use with a dilution refrigerator.

DESCRIPTION OF THE PRIOR ART

Dilution refrigerators are used for achieving ultra low temperatures for experiments in the millikelvin temperature range. A typical dilution refrigerator includes a still, a mixing chamber, and a heat exchanger connected between the still and mixing chamber whereby coolant flows from the still to the mixing chamber and from the mixing chamber to the still through respective first and second adjacent paths in the heat exchanger. Examples of known dilution refrigerators are described in US-A-5189880 and "A Simple Dilution Refrigerator" by J. L. Levine, The Review of Scientific Instruments, Vol. 43, Number 2, February 1972, pages 274–277.

Typically, such a dilution refrigerator uses $^3He/^4He$ and makes use of the fact that when a mixture of these two stable isotopes of helium is cooled below its tri-critical temperature, it separates into two phases. The lighter "concentrated phase" is rich in $^3He$ and the heavier "dilute phase" is rich in $^4He$. Since the enthalpy of the $^3He$ in the two phases is different, it is possible to obtain cooling by "evaporating" the $^3He$ from the concentrated phase into the dilute phase.

The properties of the liquids in the dilution refrigerator are described by quantum mechanics. However, it is useful to regard the concentrated phase of the mixture as liquid $^3He$, and the dilute phase as $^3He$ gas. The $^4He$ which makes up the majority of the dilute phase is inert, and the $^3He$ "gas" moves through the liquid $^4He$ without interaction. This gas is formed in the mixing chamber at the phase boundary, in a process analogous to evaporation at a liquid surface. This process continues to work even at the lowest temperatures because the equilibrium concentration of $^3He$ in the dilute phase is still finite, even as the temperature approaches absolute zero.

In a continuously operating system, the $^3He$ must be extracted from the dilute phase (to prevent it from saturating) and returned into the concentrated phase, keeping the system in a dynamic equilibrium. The $^3He$ is pumped away from the liquid surface in the still, which is typically maintained at a temperature of 0.6 to 0.7K by a small heater. At this temperature the vapour pressure of the $^3He$ is about 1000 times higher than that of $^4He$, so $^3He$ evaporates preferentially.

The concentration of $^3He$ in the dilute phase in the still therefore becomes lower than it is in the mixing chamber, and the osmotic pressure difference drives $^3He$ to the still. The $^3He$ leaving the mixing chamber is used to cool the returning flow of concentrated $^3He$ in the heat exchanger. A room temperature vacuum pumping system draws the $^3He$ gas from the still, and compresses it to a pressure of a few hundred millibar. The gas is then returned to the refrigerator.

In order for dilution refrigerators to be used to investigate samples in high magnetic fields, it has been known to provide an elongate, tubular extension to the mixing chamber which extends into the bore of a magnet. In this case, it is necessary for the $^3He$ return tube also to extend into the mixing chamber extension to promote circulation of $^3He$ around the sample which in turn is held on the end of a holder extending through the refrigerator and the return tube.

An example of such a dilution refrigerator which enables a sample to be "top-loaded" is described in "Novel Top-Loading 20 mK/15T Cryomagnetic System" by P. H. P. Reinders et al, Cryogenics 1987 Vol. 27 December, pages 689–692.

One of the problems with conventional dilution refrigerators of this type arises when a sample is to be subjected to pulsed or hybrid magnetic fields. In these situations, the bore of the magnet generating the field must be made of small diameter while, typically, in order to generate the high magnetic field strength required, the magnet must be operated in liquid helium or nitrogen at low temperature and hence be housed in a cryostat. Typically, a pulsed magnet is housed in a liquid nitrogen chamber while the mixing chamber extension is surrounded by a liquid helium chamber and a vacuum chamber both of which extend into the bore of the magnet. Thus, for a magnet having a clear bore diameter of about 15 mm, the effect of all these chambers is to reduce the available space for a sample to about 3 mm which is very undesirable.

SUMMARY OF THE INVENTION

In accordance with one aspect of the present invention, a sample holding device for a dilution refrigerator having a still, a mixing chamber, and a heat exchanger connected between the still and mixing chamber whereby coolant flows from the still to the mixing chamber and from the mixing chamber to the still through respective first and second adjacent paths in the heat exchanger and wherein the mixing chamber has a tubular portion, comprises a tube for insertion in the tubular portion of the mixing chamber and having means for holding a sample within the tubular portion, the tube having an aperture adjacent the sample holding means communicating in use between the interior of the tube and the interior of the tubular portion and another aperture positioned in use to communicate between the interior of the tube and the second path in the heat exchanger.

We have devised a new sample holding device in which the device is used not only to hold the sample but also to provide a path for coolant to pass from the mixing chamber to the heat exchanger. In this way, the available space for the sample is increased significantly.

Various different types of holding means could be provided for attaching a sample to the holding device. For example, a push fit connector or the like. Preferably, however, the leading end of the tube is screw threaded (preferably internally screw threaded) for connection to a sample connector.

Preferably, the sample holding device is removable from the dilution refrigerator without purging coolant and in that case, the device further comprises a seal for sealing the device to the refrigerator when inserted. Preferably the seal is defined by a cone shaped member, located in the dilute or concentrated mixture, which mates with a corresponding cone shaped portion on the refrigerator.

We also provide in accordance with a second aspect of the present invention a dilution refrigerator having a still, a mixing chamber, and a heat exchanger connected between the still and mixing chamber whereby coolant flows from the still to the mixing chamber and from the mixing chamber to the still through respective first and second adjacent paths in the heat exchanger and wherein the mixing chamber has a tubular portion, and a sample holding device comprising a tube for insertion in the tubular portion of the mixing chamber and having means for holding a sample within the tubular portion, the tube having an aperture adjacent the sample holding means communicating between the interior of the tube and the interior of the tubular portion and another aperture positioned to communicate between the interior of the tube and the second path in the heat exchanger.

Preferably, the sample holding device is movable from the remainder of the dilution refrigerator, the sample holding device further including a seal for sealing against a wall of the dilution refrigerator.

In the preferred example, the sample tube extends through the centre of the heat exchanger.

In the case of pulsed magnetic fields, it is preferable if all the components making up the still, heat exchanger and mixing chamber are made of non-metallic materials such as plastics, preferably PEEK. PEEK (polyetheretherketone) is particularly suitable because it has low diffusibility to helium gas, even at room temperature (300K) for the time periods required for conventional dilution unit leak testing. This simplifies leak testing procedures.

In situations where conventional magnetic fields are applied either static, or sweeping at a tolerable rate, it would be possible to employ the sample holding device within a metallic dilution unit in order to gain more sample space for a given mixing chamber tail inner diameter. In the case of non-metallic materials, where the sample holding device extends through the heat exchanger, the wall of the heat exchanger adjacent the sample holding device is made sufficiently thin to enable heat to transfer through the wall between the centre of the heat exchanger and coolant passing through the heat exchanger.

Preferably, electrical wiring for connection to the sample extends along the sample holding device.

Preferably, the sample holding device is sealed to the heat exchanger, for example by a seal comprising cooperating cone shaped members on the sample holding device and heat exchanger. Other seals could be used such as cooperating screw shaped members.

BRIEF DESCRIPTION OF THE DRAWINGS

An example of a dilution refrigerator incorporating a sample holding device according to the invention will now be described with reference to the accompanying drawings, in which.

DESCRIPTION OF THE EMBODIMENTS

Figure 1:
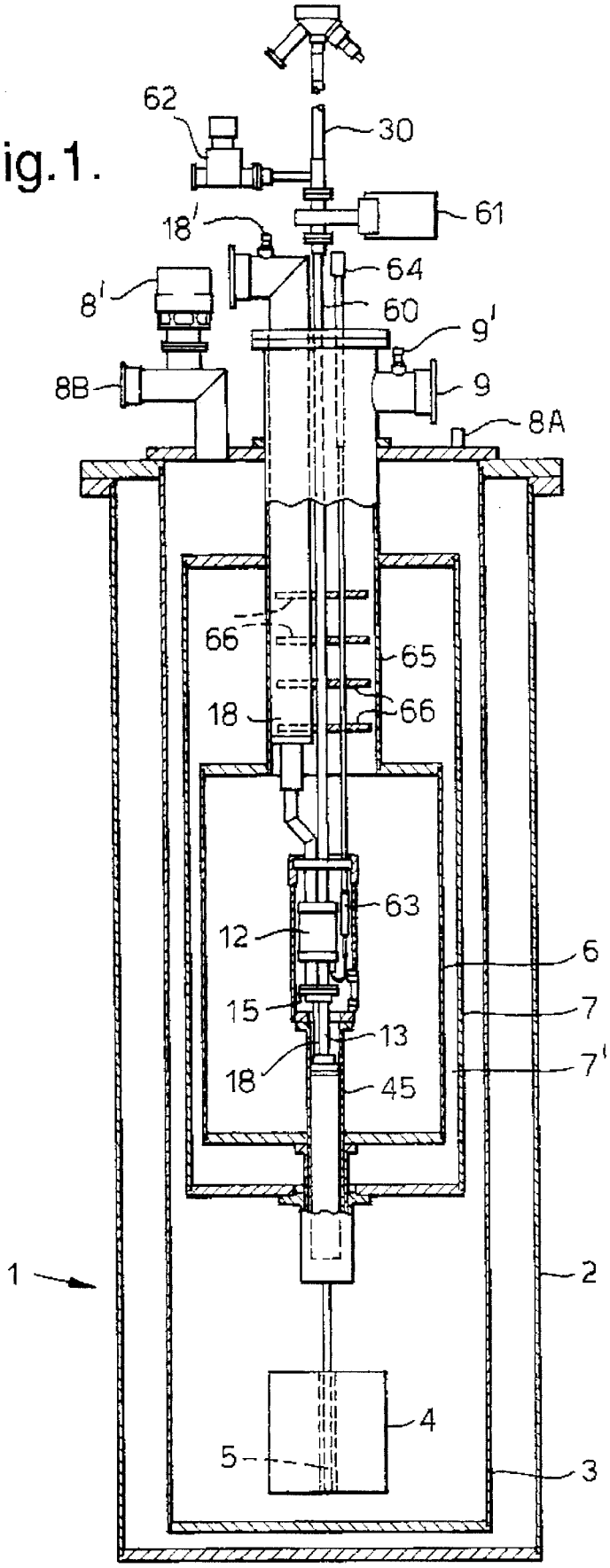
FIG. 1 is a schematic, partially cut away view of the dilution refrigerator situated within a cryostat containing a magnet.

The apparatus shown in FIG. 1 comprises a cryostat 1 having a cylindrical outer wall 2, radially inwardly of which is mounted a cylindrical wall 3 with a vacuum defined in the space between the walls 2,3. The wall 3 defines a chamber filled with liquid nitrogen and containing a magnet 4 having a bore 5. Axially positioned above the magnet 4 within the liquid nitrogen reservoir is a cylindrical liquid helium reservoir 6 separated from the liquid nitrogen reservoir by an evacuated region 7' defined between the reservoir 6 and a wall 7. An inner vacuum vessel 45 is positioned within the reservoir 6. Conventional ports 8A,8B are coupled with the liquid nitrogen reservoir for supplying and exhausting nitrogen respectively and similar ports 9 (only one shown) are provided for the helium reservoir 6. Each port 8B and 9 has an associated pressure relief valve 8', 9' respectively A dilution refrigerator is inserted along a central axis of the cryostat 1. The dilution refrigerator is of general conventional form and is shown in more detail in FIG. 2. The refrigerator includes a plastics machined cylinder 10 defining a central cylindrical bore 11. The cylinder 10 is connected to a 1K pot of conventional form 12 (FIG. 1) via a metal tube 13 located on a tubular extension 14 of the cylinder 10. The tube 13 is bonded to the 1K pot 12 by an indium seal flange 15. A tube 60 extends from the top of the 1K pot 12 in alignment with the tube 13 to a gate valve 61 above which is positioned a vacuum lock 62 for connection to a vacuum pump (not shown).

The 1K pot 12 is filled with helium from the reservoir 6 via a needle valve 63 which is connected via a tube (not shown) with the reservoir 6 on one side and to the 1K pot 12 on the other side. The needle valve 63 is controlled from a control position 64 external to the refrigerator.

The upper end of the cylinder 10 defines an upwardly opening, cylindrical bore 16 forming the still which is closed by a plug 17 into which extends a tube 18 defining a still pumping line, and electrical wiring contained in a tube 19.

The tube 18, tube 60, and control 64 extend through a neck 65 of the reservoir 6 and four radiation baffles 66 are positioned within the neck 65. Each baffle has a small clearance (4–5 mm) between its circumference and the facing surface of the neck 65.

As will be explained below, 3He is pumped along the pumping line 18 (having a pressure relief valve 18') out of the still by a pump (not shown) and is returned to a conduit 20 which extends into a helical groove 21 extending around the plastics cylinder 10. The conduit 20 terminates in a mixing chamber 22 in another plastics cylinder 23 having a socket 24 into which the end of the cylinder 10 is received. A tube extension 46 is provided in the mixing chamber 22. A non-metallic tube 25 extends around the groove 21 and part of the cylinder 23. The groove 21 and conduit 20 cooperate together to define a heat exchanger 26.

Figure 5:
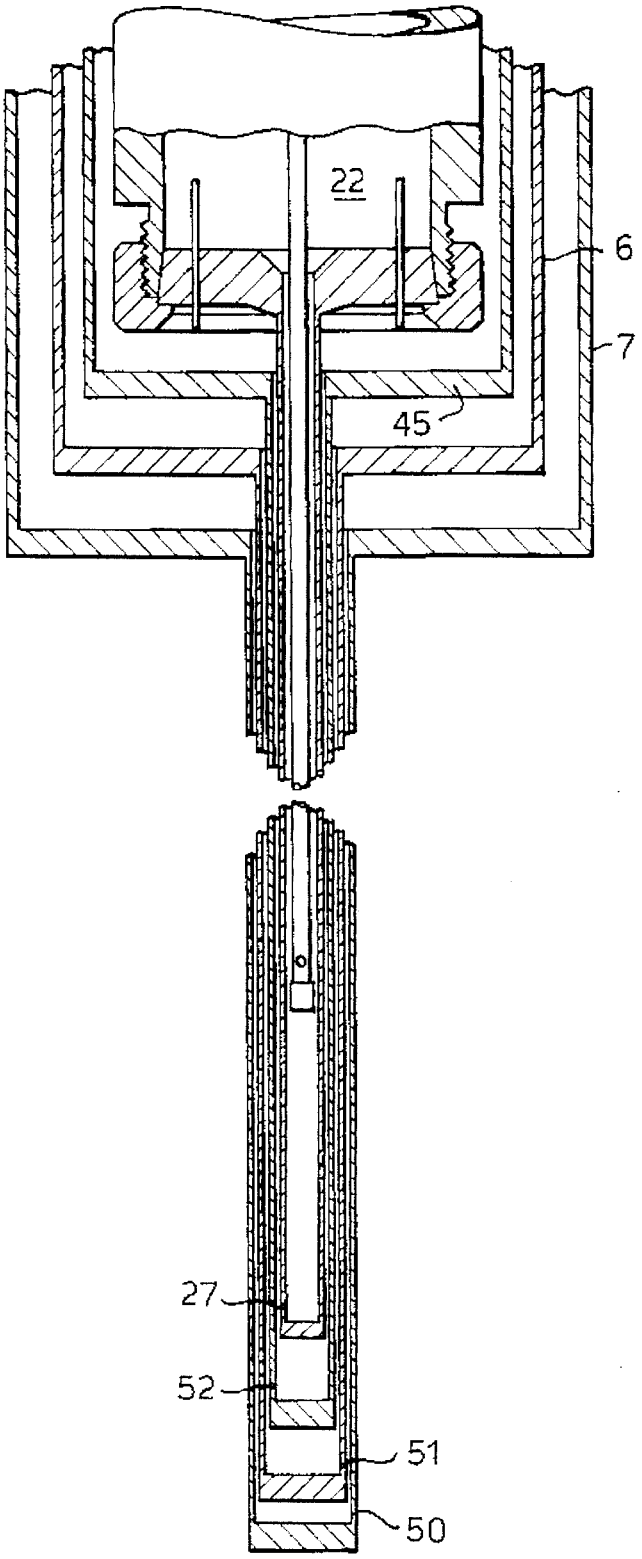
FIG. 5 illustrates the lower part of FIG. 1 in enlarged form.

A member 27 defines an elongate extension tail of the mixing chamber 22 and is situated in use in the bore 5 of the magnet 4 as shown in FIG. 1. As shown in FIG. 5, the bore 5 of the magnet has within it a wall 50 defining part of the liquid nitrogen reservoir within which is a vacuum space containing a liquid helium tail 51 connected to the liquid helium reservoir 6, an inner vacuum chamber tail 52 connected to an inner vacuum vessel 45, and the extension tail 27 of the mixing chamber 22. Typically, the clear diameter of the bore 5 would be about 15 mm. Each tail has a wall thickness of about 0.5 mm and is separated from adjacent tails by a radial distance of about 1 mm and as can be seen this reduces considerably the space available for a sample in the extension tail 27.

Figure 2:
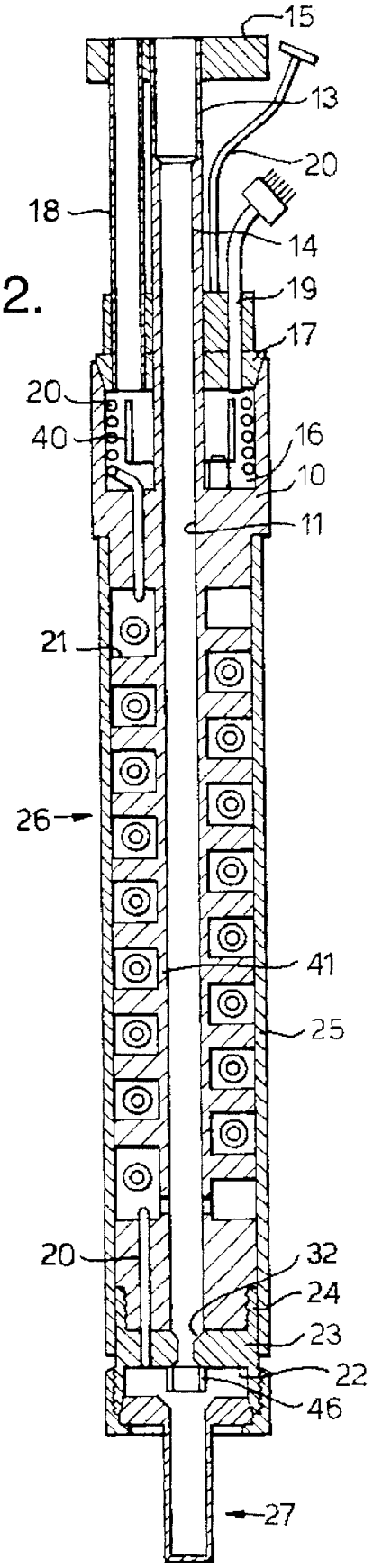
FIG. 2 illustrates the components of the dilution refrigerator in more detail.
Figure 3:
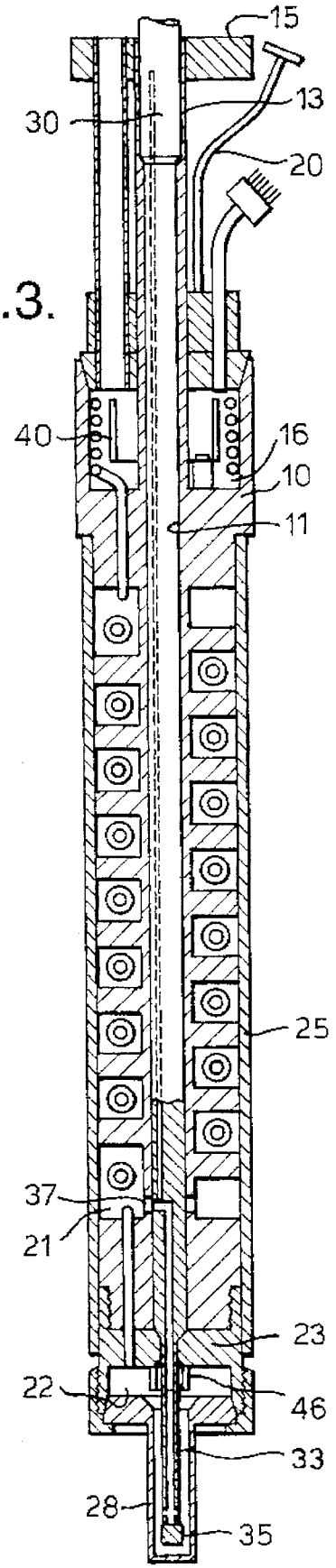
FIG. 3 illustrates the dilution refrigerator shown in FIG. 2 with a probe inserted.
Figure 4:
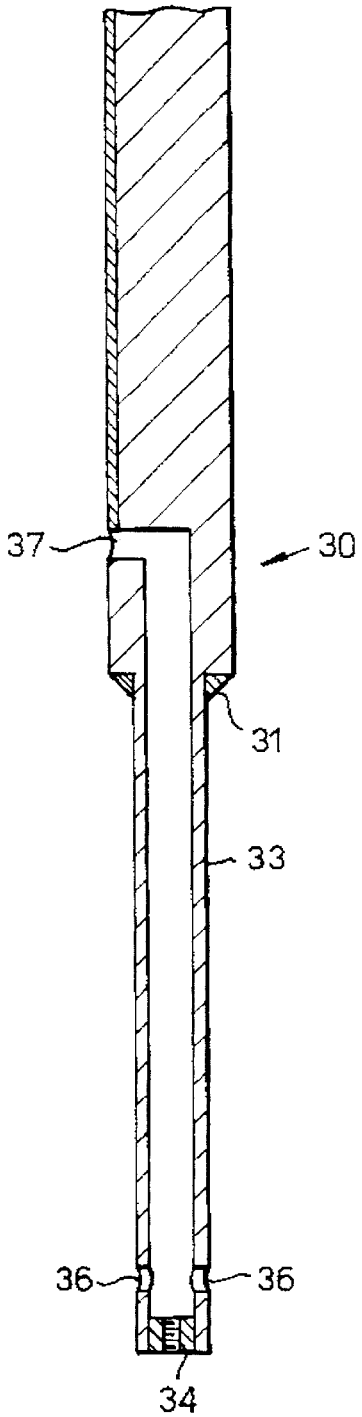
FIG. 4 illustrates the lower part of the probe shown in FIG. 3 in more detail.

FIG. 3 illustrates the dilution refrigerator of FIG. 2 but with a sample holding device or probe inserted. The probe is indicated at 30 and comprises a plastics cylinder which extends through the bore 11 of the plastics cylinder 10. The end of the probe 30, which is shown in detail in FIG. 4, has towards its lower end a cone shaped cold seal 31 which sits in a correspondingly shaped seat 32 defined by the plastics cylinder 23. A narrower section 33 of the probe 30 extends through the mixing chamber 22 and terminates near the bottom of the extension tail 27. The lower end of the section 33 includes a member 34 bonded to its internal surface and being internally screw threaded. This then enables a sample 35 to be attached to the portion 33. Typically, the sample 35 will be fixed, for example, via a suitable connector screwed to the member 34. The probe 30 is then lowered into the dilution refrigerator from the top until the cold seal 31 seats against the seat 32. The probe 30 is held under externally applied pressure to keep it sealed to the seat 32.

The lower section 33 of the probe 30 also includes a number of orifices 36 circumferentially spaced around the section 33 to allow $^3$He to pass into the section 33. The passage in the section 33 terminates in a radially opening orifice 37 which communicates in use with the groove 21 in the heat exchanger (See FIG. 3).

Typically, the inside diameter of the tubular section 33 is about 2 mm. Electrical wiring (not shown) will extend through this section 33 for connection to the sample.

The operation of the dilution refrigerator can be briefly explained as follows. The mixing chamber 22 includes a mixture of $^3$He and $^4$He. There exists a phase boundary within the mixing chamber and $^3$He gas is "evaporated" from a "concentrated phase" into the dilute phase defined principally by $^4$He. The $^3$He "gas" then moves through the liquid 4He down into the tail 27, through the apertures 36 and up through the tubular section 33 of the probe 30 into the groove 21 of the heat exchanger 26. The $^3$He gas then moves up through the helical groove 21 into the still 16 from where it is pumped through the conduit 18 and back in concentrated form to the return line 20. The $^3$He is maintained at a temperature of 0.6 to 0.7K in the still 16 by a heater 40. The returned $^3$He passes through the conduit 20 within the groove 21 where it is cooled by the $^3$He leaving the mixing chamber 22 until it is fed into the mixing chamber 22 and the cycle continues.

Some $^3$He may leak past the cold seal 31 into the bore 11 of the moulding 10. As long as the impedance of this path is much greater than that of the flow from still through heat exchanger to mixing chamber this leak path will not adversely affect the refrigerators performance. The wall of the heat exchanger 26 adjacent the helical groove 21, for example at 41, is made sufficiently thin so that heat exchange can take place between the liquid and probe in the central bore 11 and liquid within the groove 21.

The reason for the tube extension 46 is that if the phase boundary between the dilute and concentrated phases is set up correctly, any "crossover" leak occurring at the cone seal would still cause $^3$He to cross the phase boundary thereby creating cooling. Without the extension tube a crossover leak would cause the $^3$He just to be taken from the concentrated phase without forcing it to cross the phase boundary.

We claim:

1. A sample holding device for a dilution refrigerator having a still, a mixing chamber, and a heat exchanger connected between the still and mixing chamber whereby coolant flows from the still to the mixing chamber and from the mixing chamber to the still through respective first and second adjacent paths in the heat exchanger and wherein the mixing chamber has a tubular portion, the sample holding device comprising a tube for insertion in the tubular portion of the mixing chamber and having means for holding a sample within the tubular portion, said tube having an aperture adjacent said sample holding means communicating between the interior of said tube and the interior of the tubular portion when said device is positioned in the dilution refrigerator and another aperture positioned to communicate between the interior of said tube and the second path in the heat exchanger.

2. A device according to claim 1, wherein the device is removable from the remainder of the dilution refrigerator, the device having a seal for sealing against a wall of the dilution refrigerator.

3. A device according to claim 1, wherein said holding means comprises a screw threaded member at a leading end of said tube.

4. A device according to claim 1, wherein said device is constructed of a non-metallic material.

5. A device according to claim 4, wherein said device is constructed of plastics.

6. A dilution refrigerator having a still, a mixing chamber, and a heat exchanger connected between the still and mixing chamber whereby coolant flows from said still to said mixing chamber and from said mixing chamber to said still through first and second adjacent paths respectively in the heat exchanger and wherein said mixing chamber has a tubular portion, and a sample holding device comprising a tube for insertion in the tubular portion of the mixing chamber and having means for holding a sample within the tubular portion, said tube having an aperture adjacent said sample holding means communicating between the interior of said tube and the interior of the tubular portion when said device is positioned in the dilution refrigerator and another aperture positioned to communicate between the interior of said tube and the second path in the heat exchanger, said sample holding device extending into said tubular portion of the mixing chamber and communicating with the second path in the heat exchanger.

7. A refrigerator according to claim 6, wherein said sample holding device extends through a central bore of said heat exchanger, said wall of the heat exchanger defining the central portion being sufficiently thin to enable heat conduction to occur therethrough.

8. A dilution refrigerator according to claim 6, the refrigerator containing $^3$He and $^4$He.

9. A dilution refrigerator according to claim 6, wherein at least the components making up said still and said heat exchanger are non-metallic.

10. A dilution refrigerator according to claim 9, wherein at least the components making up said still and said heat exchanger are plastics.

11. A dilution refrigerator according to claim 10, wherein the components making up said still and said heat exchanger are made of PEEK.

12. A dilution refrigerator according to claim 6, wherein said sample holding device is sealed to said heat exchanger.

13. A dilution refrigerator according to claim 12, wherein the seal comprises cooperating cone shaped members on the sample holding device and heat exchanger.

* * * * *